US008142094B2

(12) United States Patent
Kaleta et al.

(10) Patent No.: US 8,142,094 B2
(45) Date of Patent: Mar. 27, 2012

(54) CLEANING IMPLEMENT WITH SPRAY NOZZLE

(76) Inventors: Bryan Kaleta, Darien, IL (US); Mark Kaleta, Chicago, IL (US)

( * ) Notice: Subject to any disclaimer, the term of this patent is extended or adjusted under 35 U.S.C. 154(b) by 288 days.

(21) Appl. No.: 12/384,557

(22) Filed: Apr. 6, 2009

(65) Prior Publication Data

US 2009/0252546 A1 Oct. 8, 2009

Related U.S. Application Data

(60) Provisional application No. 61/123,222, filed on Apr. 7, 2008.

(51) Int. Cl.
*A47L 13/26* (2006.01)

(52) U.S. Cl. ..... 401/139; 401/137; 401/270; 15/320

(58) Field of Classification Search ..... 401/24, 401/137, 139, 140, 270, 271, 289, 268; 15/115, 15/116.1, 116.2, 119.1, 119.2, 210.1, 228; 222/192, 631
See application file for complete search history.

(56) References Cited

U.S. PATENT DOCUMENTS 5,888,006 A 3/1999 Ping et al.
5,988,920 A * 11/1999 Kunkler et al. ..... 401/138
6,151,748 A * 11/2000 Earhart et al. ..... 15/321
6,289,551 B1 * 9/2001 Basile ..... 15/320
6,579,023 B2 6/2003 Kunkler et al.
6,584,990 B2 * 7/2003 Shaw ..... 134/105
6,655,866 B1 * 12/2003 Morad et al. ..... 401/139
6,899,485 B2 * 5/2005 Hall et al. ..... 401/140
6,948,873 B2 9/2005 Policicchio et al.
7,048,804 B2 * 5/2006 Kisela et al. ..... 134/21
7,096,531 B2 8/2006 Policicchio
7,380,307 B2 * 6/2008 Tsai ..... 15/320
7,431,524 B2 * 10/2008 Sacks ..... 401/139
7,441,301 B2 * 10/2008 Kresse et al. ..... 15/228
2001/0003563 A1 * 6/2001 Schauer et al. ..... 401/5
2002/0176735 A1 * 11/2002 Dingert et al. ..... 401/270
2004/0134016 A1 * 7/2004 Kisela et al. ..... 15/320
2004/0139572 A1 * 7/2004 Kisela et al. ..... 15/320
2005/0095053 A1 * 5/2005 Harris ..... 401/138
2007/0214586 A1 * 9/2007 Mattucci et al. ..... 15/4

* cited by examiner

*Primary Examiner* — David J. Walczak
*Assistant Examiner* — Jennifer C Chiang
(74) *Attorney, Agent, or Firm* — Knechtel, Demeur & Samlan

(57) ABSTRACT

A floor mop for cleaning a surface by wet mopping in which the mop has a spray nozzle mounted in the mop head. There is a handle connected to the mop head by a universal joint. A cloth is removably mounted on the under surface of the mop head for easy replacement when it is soiled or worn out. A fluid tank is mounted in the mop head. A pump is connected to the fluid tank. A wireless signal generator is mounted on the handle for sending a wireless signal to a receiver in the mop head for activating the pump for spraying fluid onto the surface to effect wet mopping when the wireless signal is received.

10 Claims, 4 Drawing Sheets

CLEANING IMPLEMENT WITH SPRAY NOZZLE

I. CROSS REFERENCE TO RELATED APPLICATIONS

This application is based on and claims priority of provisional patent application 61/123,222 filed Apr. 7, 2008.

II. FIELD OF THE INVENTION

This invention relates to hand held cleaning implements and more particularly to a hand held mop with a spray nozzle for dispensing liquid onto a floor wherein the mop has a removable cleaning pad.

III. BACKGROUND AND SUMMARY OF THE INVENTION

Cleaning devices for cleaning hard surfaces come in many sizes, shapes and configurations. For example, there are numerous string mops that have an elongated handle with a plurality of strings or woven fibers on the lower end which contact the hard surface to be cleaned. The strings or woven fibers are wrung out, generally by means of a mechanical wringer, after mopping the surface. The process is continued until the entire surface is cleaned.

In another type of mop, a sponge is placed at the lower end of the handle and contacts the floor. The sponge is wrung out after it is saturated. The wringing process is generally accomplished by a mechanical wringer so that the user does not have to physically contact the dirty sponge element. When the sponge shows substantial wear, it can be replaced.

In yet another type of hand held cleaning device, disposable cleaning sheets are attached to the mop head and contact the floor. The sheets can be pre-moistened with water or cleaning solution or water or cleaning solution can be placed on the floor and mopped up by the cleaning sheet. When the sheets are either completely soiled or worn out, they are removed, discarded and replaced by a new sheet.

Applicant's invention is an improvement over the prior art devices. The invention comprises an elongated handle having a grasping top end and a lower cleaning end. There is a mop head pivotally mounted to the lower end. There are liquid holding tanks, a battery compartment, a pump, a nozzle and associated electrical and plumbing connections, preferably all mounted in the mop head. There is a switch mounted in the top end of the handle so that it can be easily controlled by the user. When the switch is operated, the pump is activated and pumps liquid from the liquid holding tanks to the nozzle. The nozzle sprays the liquid onto the floor in front of the mop head. A cleaning pad is mounted to the underside of the mop head to contact and clean the floor. When the cleaning pad is soiled, it can be removed and replaced with a new clean pad. The pads are preferable washable so that they can be re-used. The switch on the handle preferably activates an infrared beam that is directed to a receiver on the mop head to operate the pump. Alternatively the switch may activate a radio signal to operate the pump.

IV. OBJECTS OF THE INVENTION

It is an object of the invention to provide a handheld floor mop that has a spray nozzle mounted in the mop head.

It is a further object to provide a handheld floor mop that uses an easily replaceable cloth which is removably mounted on the under surface of the mop head when the cloth is soiled or worn out.

Yet another object is to provide a handheld floor mop that has a fluid tank mounted in the mop head.

Still another object is to provide a handheld floor mop that has a wireless signal generator mounted on the handle for sending a wireless signal to a receiver in the mop head for activating a pump for spraying fluid onto the surface to be cleaned.

V. DESCRIPTION OF THE DRAWINGS

VI. DETAILED DESCRIPTION OF THE PREFERRED EMBODIMENT

Figure 1:
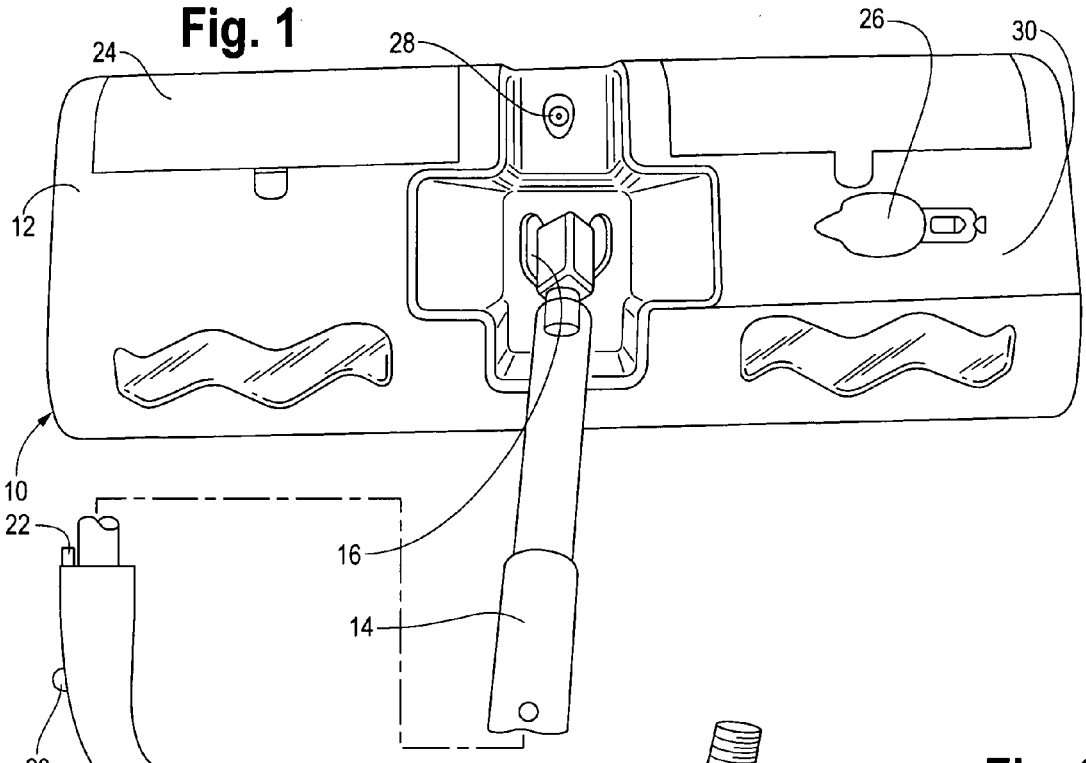
FIG. 1 is a top plan view of the mop with portions removed.
Figure 6:
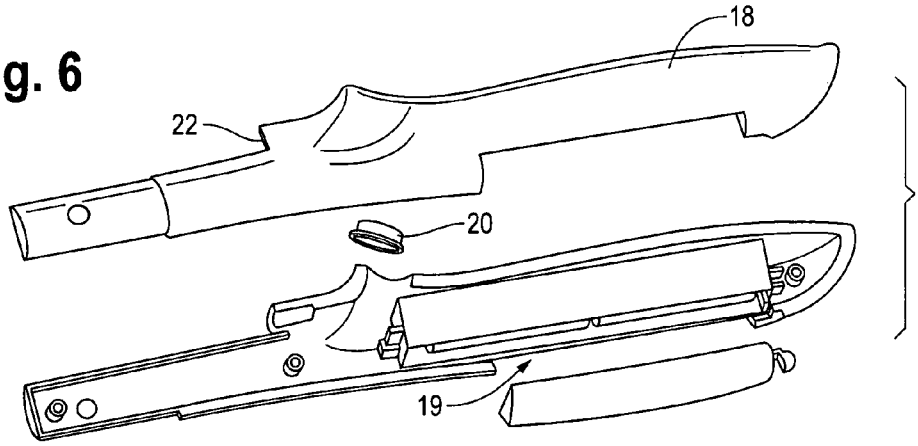
FIG. 6 is an exploded view of the grasping portion of the mop.

Turning first to FIG. 1, a hand held cleaning implement or mop 10 of the present invention is disclosed. There is a mop head 12 connected to an elongated handle 14 by means of a universal pivot 16. At a top end of the elongated handle 14 is a grasping portion or handle 18 which the user holds to push, pull, turn or otherwise move the mop 10. As also illustrated in FIG. 6, there is an on-off button 20 mounted on the handle 18 which turns on and off an infrared light emitter 22. There is a battery compartment 19 which holds a battery to supply power to the emitter 22. On the mop head 12 is a battery compartment cover 24 and a filler cap 26. There is also an infrared receiver 28 which is optically aligned with the emitter 22.

Figure 2:
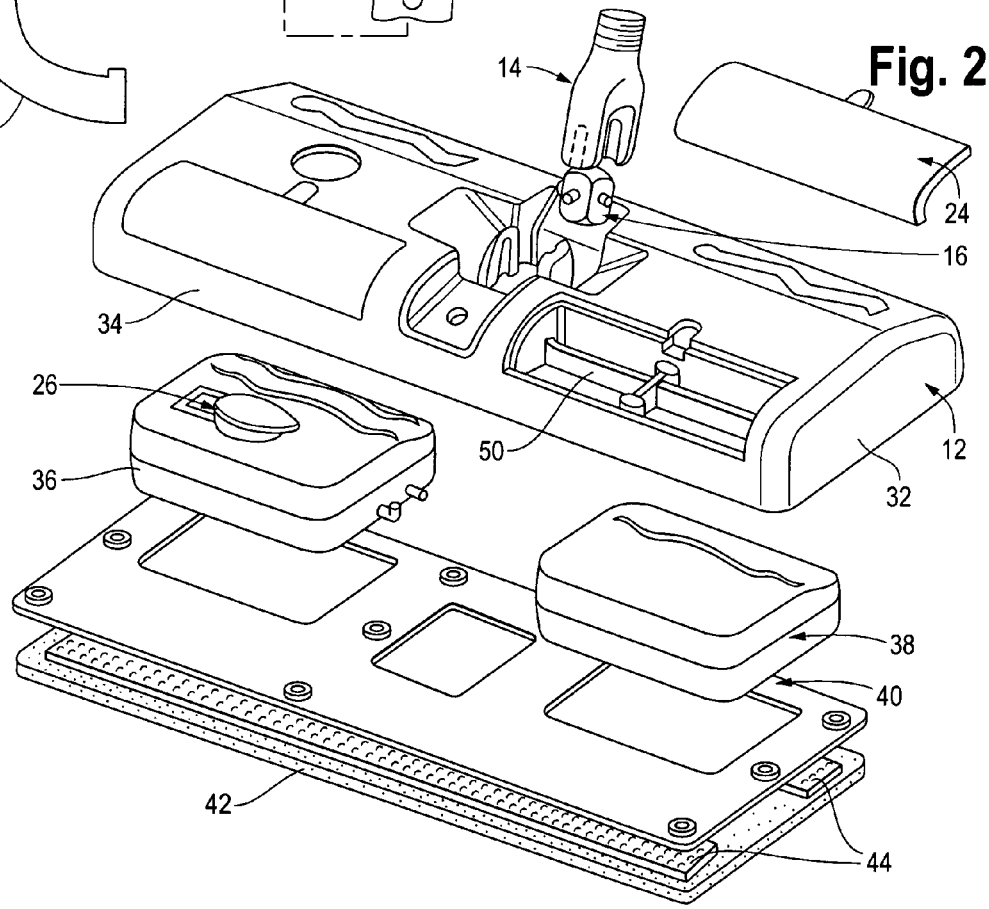
FIG. 2 is an exploded view of the mop with portions removed.

FIG. 2 illustrates the assembly of some of the interior components of the mop head 12. The mop head 12 has a top surface 30, short sides 32 and long sides 34. The universal pivot 16 is attached to the top surface 30. There is a first water tank 36 and a second water tank 38. The water tanks are mounted within the mop head 12. There is a bottom 40 that covers the bottom of the mop head 12. Mounted to the bottom 40 is a cleaning pad 42 that is preferably made of a soft, absorbent material. The cleaning pad 42 is preferably washable so that it can be cleaned and re-used. One such material that has been successfully tested is microfiber that has all of these characteristics. On one side of the cleaning pad 42 is placed a fastener 44 such as a hook and loop fastener sold under the trademark Velcro. The complementary piece of the fastener 44 is mounted to the underside of the bottom 40. This type of fastener 44 is easy to mount onto the pad 42 and bottom 40 and easily allows the pad to be removed and replaced with a new or cleaned pad.

Figure 3:
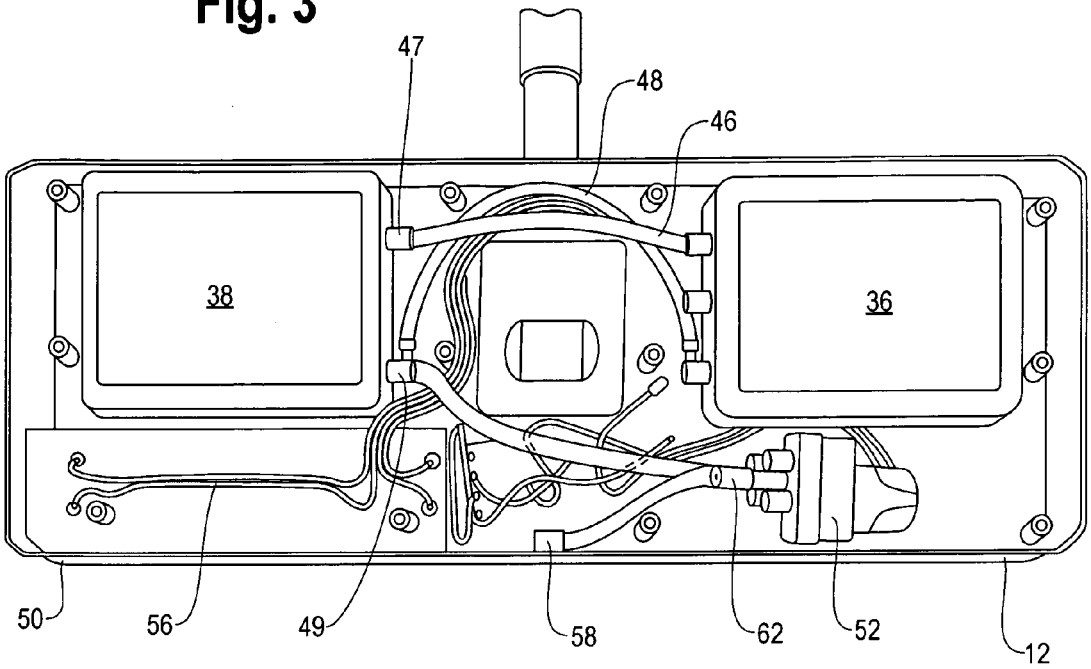
FIG. 3 is a bottom view of the mop head with the bottom removed for clarity of viewing the interior components.

FIG. 3 illustrated how the interior components are mounted into the mop head 12. The first and second water tanks 36, 38 are mounted to opposite sides of the universal pivot 16. The first water tank 36 is filled through a filler cap 26 on the top surface 30 of the mop head 12. A water line 46 fluidly connects the bottoms of the first and second water tanks 36, 38 and provides a fluid passageway between the two tanks, 36 and 38. As the first water tank 36 is filled, water flows out through an exit hole near the bottom of the first water tank 36. The second water tank 38 is filled through an entrance hole 47. The entrance hole 47 is placed near the bottom of the tank so that the tanks 36, 38 freely transfer water between them and maintain the same water level in both tanks. Using two tanks provides a larger reservoir than if just a single tank 36 or 38 was used. There is also an air line 48 between the tanks 36, 38 so that as fluid is drawn from the tanks 36, 38, a vacuum is not created which would restrict or inhibit the flow of water out from the tanks 36, 38. A second hole 49 is placed in the top portion of the tanks 36, 38 to which an air line 48 is connected. There is a small vent hole provided in the filler cap 26 to allow air to enter the first water tank 36. The filler cap can be provided with a one way valve to allow the air to enter the water tank 36 yet not allow water to splash back out of the tank 36.

The mop head 12 also has a battery compartment 50 under the battery compartment cover 24. This houses the electrical power source for operating all of the electrical components contained in the mop head 12. The power can be provided by either one or more rechargeable batteries or conventional batteries. There is a pump 52 that is fluidly connected by means of a tube 54 to the second water tank 38. The pump 52 is also electrically connected to the battery compartment 50 by means of electrical wires 56. There is a spray nozzle 58 mounted to the front of the mop head 12, generally in the center of the front long side 34. The nozzle 58 is fluidly connected to the discharge end of the pump 52 by means of a spray nozzle tube 62. The nozzle 58 sprays a mist of water in front of the mop head 12. It should also be noted that the electrical power source provides power to the infrared receiver 28.

Figure 4:
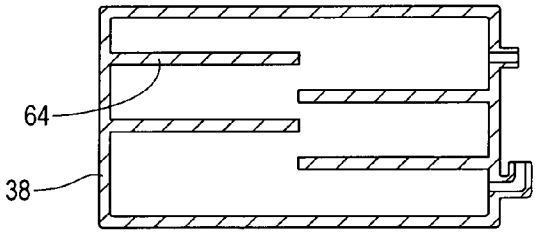
FIG. 4 is a cross section view of the water tank illustrating the baffles.
Figure 5:
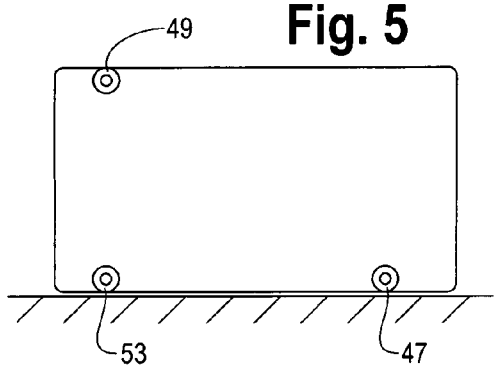
FIG. 5 is an end view of the water tank as it is oriented in the position in which the mop is normally oriented when cleaning a floor.

FIG. 4 is a cross section view of the water tank 38. The inside of the water tank 36 is substantially identical. There are baffles 64 disposed inside of the water tanks 36, 38 to keep the water level substantially level during discharge of water from the spray nozzle 58. The baffles 64 keep the water from splashing around within the tanks and minimize the possibility of the water splashing up above a discharge port 53 leading from the second water tank 38 into the water line 54. This helps minimize the likelihood of the pump 52 not receiving an adequate amount of water from the tank 38 and resulting in not being able to deliver it to the spray nozzle 58.

It is very easy to operate the mop 10. The user fills the water tanks 36, 38 through the filler cap 26. Either plain water can be used or a variety of additives can be added. Examples are fragrances, vinegar, or any of a variety of cleaning agents can be added. Throughout this application, the term "water" was used, however it is meant to include water with whatever additives the user wishes to employ. The batteries must be charged and if not already inserted into the battery compartment on the mop head and the handle 18, must be properly installed. The cleaning pad 42 is on the bottom 40, or again if a new pad is required, the user merely places a new pad onto the bottom 40 by means of the fastener 44. The user pushes the on-off button 20 on the handle 18 which transmits an infrared beam from the emitter 22 to the receiver 28. This closes an electrical circuit in the mop head 12 which starts the pump 52. As long as the user holds the button 20 in a depressed or "on" position, the infrared beam is sent to the receiver keeping the circuit closed and the pump "on". The pump 52 draws water or whatever cleaning solution is in the water tank 38 and pumps it to the spray nozzle 58 where it is discharges in a spray or mist in front of the mop head 12. This wets the floor surface so that the cleaning pad 42 can mop up the dirt from the floor. More or less cleaning solution can be sprayed by the user as needed just by depressing the button 20. When the cleaning pad 42 is dirty, it is removed and washed for re-use. Only when it is worn out must it be discarded.

The infrared switch can also be designed so that if the receiver 28 receives a signal from the emitter 22, it can close the switch which remains closed until the user sends another signal to the receiver signaling the switch to open.

In another embodiment, the infrared emitter 22 is replaced with a radio control frequency transmitter which is received in the mop head 12. Once the signal is received, the mop operates in the same manner as the previously described embodiment.

In yet another embodiment, the battery compartment 50 and pump 52 is hard wired to the switch 20 so that when the switch is closed, the pump is activated. In this embodiment, the mop operates as previously described except that no infrared, radio control or other radio waves are transmitted from the grasping portion 18. However, the water tanks 36, 38 are still stored in the mop head 12 and not on the handle 14.

Figure 7:
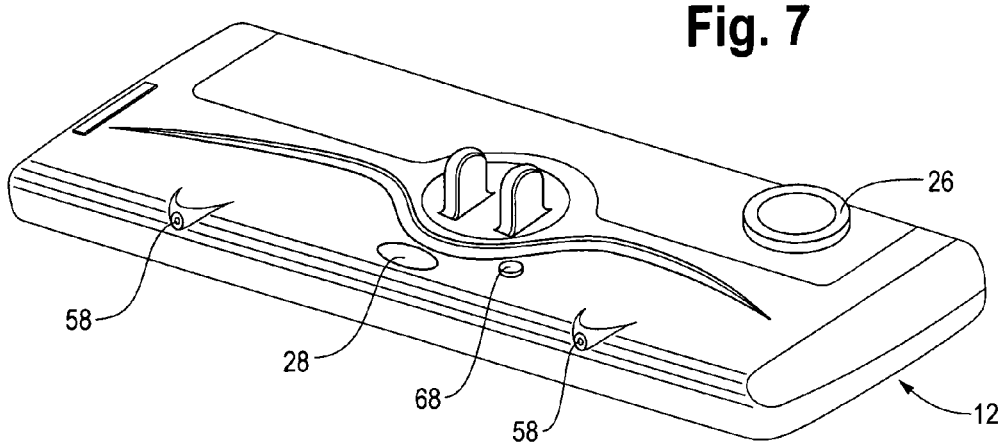
FIG. 7 is a front perspective view of an alternate embodiment of the mop head, with the handle removed.
Figure 8:
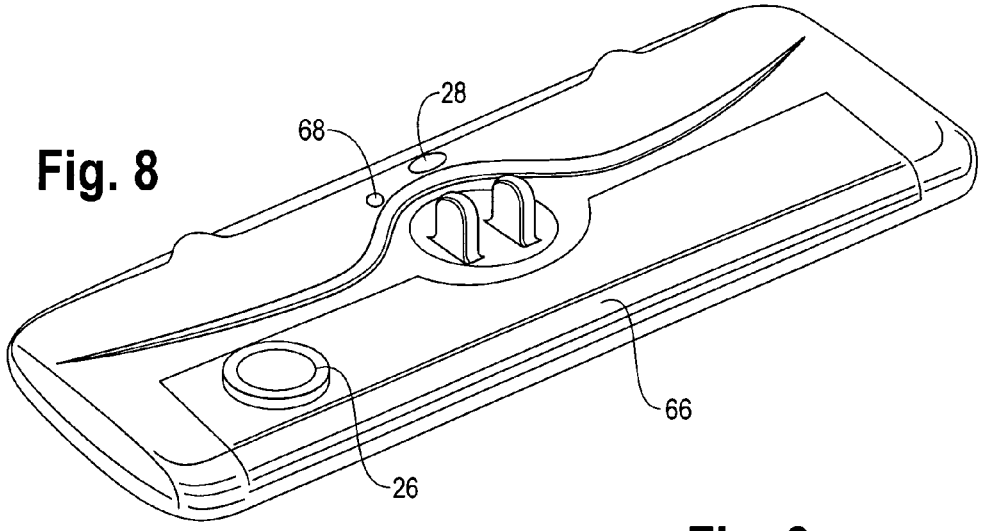
FIG. 8 is a rear perspective view of the alternate embodiment of the mop head, with the handle removed.
Figure 9:
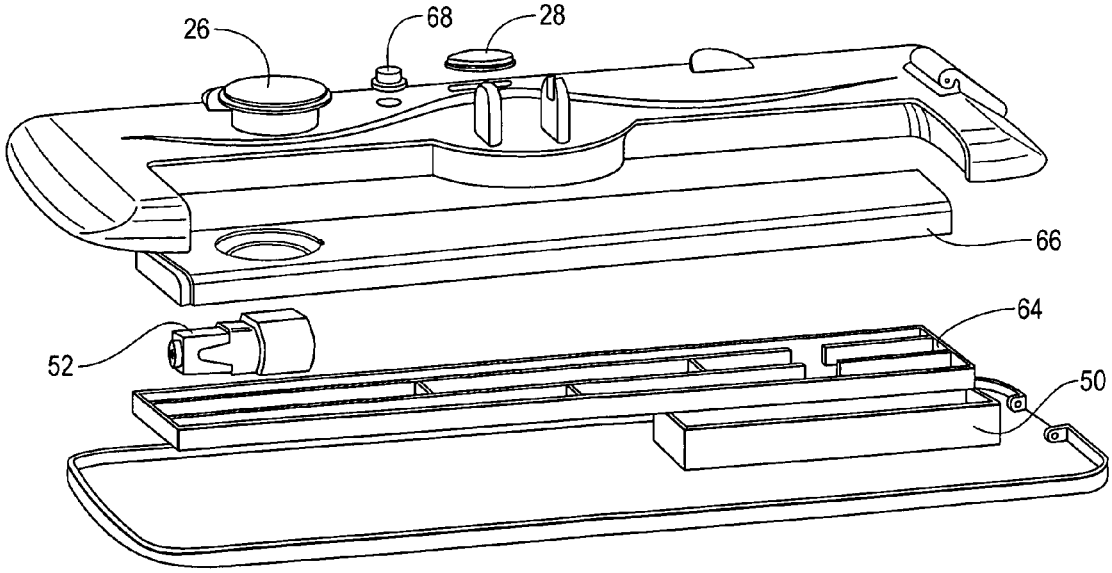
FIG. 9 is an exploded view of the alternate embodiment of FIG. 7, illustrating the components in the mop head.

In the alternate embodiment illustrated in FIGS. 7-9, the basic operation of the mop head 12 is unchanged. However there are some differences. As seen in FIG. 7, the mop head 12 has a filler cap 26. However instead of two water tanks, there is a single water tank 66 with baffles 64. The battery compartment 50 is still located in the mop head 12 and provides power to the pump 52 and the electrical system housed in the mop head 12. Also, there are two spray nozzles 58 mounted on the front of the mop head 12. In this embodiment there is also an on-off switch 68 that turns the electrical system on and off. When turned on, the system is active and the electric circuit board that controls the receiver and pump are ready to operate. When the switch 68 is turned off, inadvertent or accidental operation of the pump is alleviated.

Figure 10:
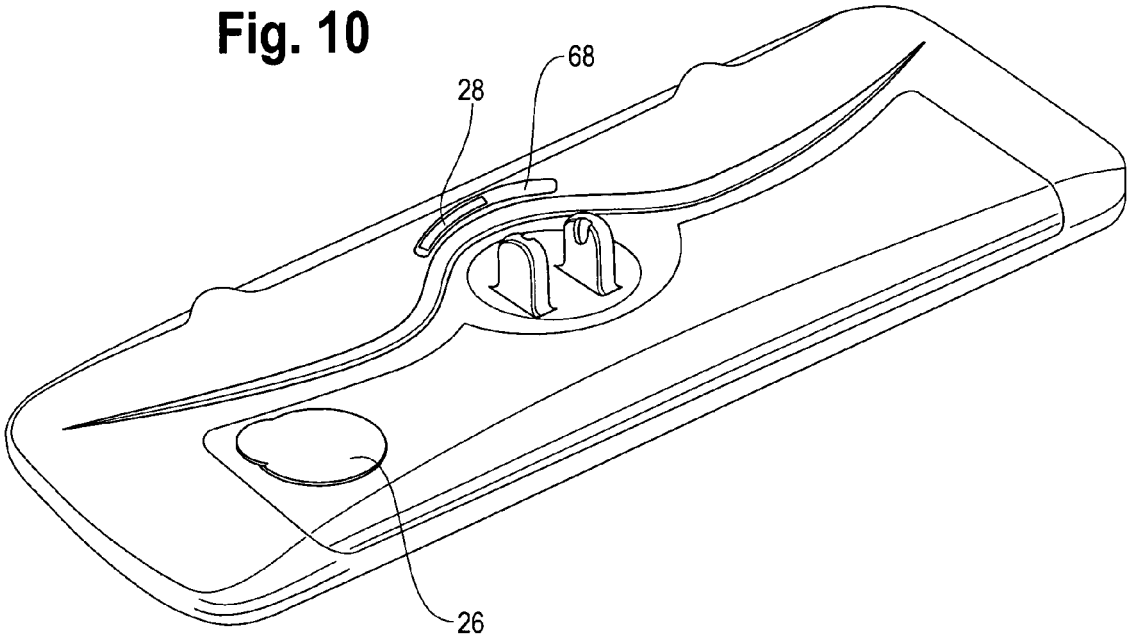
FIG. 10 is a rear perspective view of a second alternate embodiment of the mop head, with the handle removed.
Figure 11:
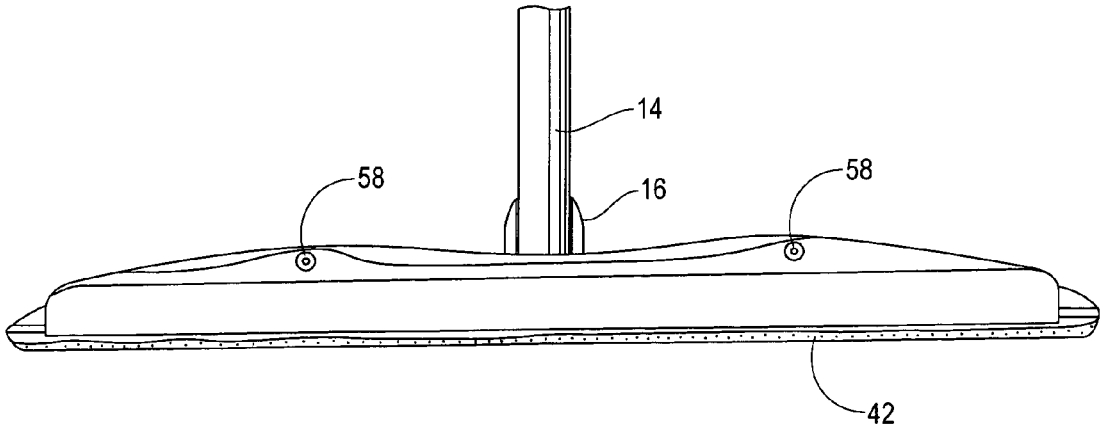
FIG. 11 is a front elevation view of the second alternate embodiment of the mop head.

Another embodiment as seen in FIGS. 10-11 is similar to the embodiment illustrated in FIG. 7-9 except the receiver 28 and on-off switch 68 are mounted next to each other. Otherwise the operation of the mop is identical to the previously described embodiment.

While there has been described a cleaning implement that has been disclosed in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A floor mop comprising:

an elongated handle having opposite top and bottom ends;

a mop head with a top, bottom, front, back, and opposite first and second sides;

a universal joint mounted at the bottom end of the elongated handle for connecting the bottom end to the top of the mop head;

a cleaning pad attached to the bottom of the mop head;

mounting means on the bottom of the mop head and on the cleaning pad for removably attaching the cleaning pad to the bottom of the mop head;

a spray nozzle mounted on the mop head;

a cleaning solution storage tank mounted in the mop head;

a pump fluidly connected to the cleaning solution storage tank for receiving cleaning solution from the cleaning solution storage tank and pumping it out through the nozzle;

a wireless signal generating means mounted on the elongated handle for transmitting a wireless signal;

a wireless signal receiver means on the mop head;

means for operating the pump in response to the wireless signal receiver means receiving the wireless signal from the wireless signal generating means thereby causing the cleaning solution to be discharged through the nozzle in response to the wireless signal generating means transmitting the wireless signal to the receiver means.

2. The floor mop of claim 1 wherein the mop head has a front with the spray nozzle mounted on the front of the mop head so that the nozzle directs the cleaning solution in front of the mop head.

3. The floor mop of claim 1 wherein the wireless signal generating means comprises a transmitter, a power source for providing power to the transmitter and a switch for turning the transmitter on and off.

4. The floor mop of claim 3 wherein the transmitter is an infrared signal transmitter.

5. The floor mop of claim 3 wherein the transmitter is a radio frequency transmitter.

6. A floor mop adapted to be moved over a surface and clean that surface by wet mopping comprising:

a mop head having a periphery and an under surface, a handle having opposite top and bottom ends, the bottom end connected to the mop head by a universal joint, a cloth removably mounted on the under surface of the mop head, the cloth permitting the head to engage the surface by permitting relatively free movement of the head over the surface in any horizontal direction, the universal joint permitting free horizontal movement of the mop head with respect to the handle when moving the mop head over the surface, a fluid tank mounted in the mop head, a pump in fluid communication with the fluid tank, a signal generating means on the top of the handle for sending a wireless signal to a receiver for activating the pump, and a spray nozzle in fluid communication with the pump for discharging fluid onto the surface to effect wet mopping when the wireless signal is received.

7. The floor mop of claim 6 wherein the spray nozzle is mounted on the mop head.

8. The floor mop of claim 6 wherein the signal generating means comprises a transmitter, a power source for providing power to the transmitter and a switch for turning the transmitter on and off.

9. The floor mop of claim 8 wherein the transmitter is an infrared signal transmitter.

10. The floor mop of claim 8 wherein the transmitter is a radio frequency transmitter.

* * * * *